United States Patent [19]

Rardin et al.

[11] 4,135,624

[45] Jan. 23, 1979

[54] PLASTIC FILE SLEEVE AND INDEX CARDS

[76] Inventors: Jack A. Rardin; Gregory A. James, both of 617 18th St., Charleston, Ill. 61920

[21] Appl. No.: 879,577

[22] Filed: Feb. 21, 1978

Related U.S. Application Data

[63] Continuation of Ser. No. 738,648, Nov. 4, 1976, abandoned.

[51] Int. Cl.[2] ..... B65D 85/00

[52] U.S. Cl. ..... 206/425; 206/449; 206/806

[58] Field of Search ..... 206/425, 424, 806, 449; 312/184

[56] References Cited

U.S. PATENT DOCUMENTS

| | | | |
|---|---|---|---|
| 1,217,243 | 2/1917 | Tucker et al. | 312/184 |
| 1,876,181 | 9/1932 | Tussing | 206/425 |
| 2,247,593 | 7/1941 | Weber | 206/425 |
| 2,258,666 | 10/1941 | Walker | 206/425 |
| 3,311,257 | 3/1967 | Puente | 220/72 |
| 3,724,920 | 4/1973 | Reck | 206/425 X |

FOREIGN PATENT DOCUMENTS

| | | | |
|---|---|---|---|
| 220505 | 8/1942 | Switzerland | 206/425 |

*Primary Examiner*—William Price
*Assistant Examiner*—Joseph Man-Fu Moy
*Attorney, Agent, or Firm*—Ernest S. Kettelson

[57] ABSTRACT

A plastic file sleeve and index card set for organized record retention and use, including a sleeve having two relatively wide end walls, two relatively narrow side walls, open at the top and bottom defining a sleeve cavity therein to receive index file cards as described. The index file cards include a body portion having a width corresponding to that of the sleeve cavity for insertion therein, and include a tabulating strip portion across the top of the card which is wider than the sleeve. The tabulating strip portion of the cards includes shoulder portions which project outwardly from each opposite end beyond the corresponding respective side edges of the body portion of the cards. The outwardly projecting shoulder portions of the cards rest against the top edge of the sleeve, thereby supporting the tabulating strip portion above the sleeve for visual examination without having to reach in the sleeve and withdraw cards for examination. The tabulating strip portion of each card includes a rectangular panel across its width and a raised tab portion projecting upwardly from the upper edge of the rectangular panel. The raised tab portion is located at a different point on each card in the set and arranged so a portion of each tab is visible when the cards are placed in the sleeve. The side walls of the sleeve include longitudinal ribs formed on the inward facing surfaces thereof.

8 Claims, 5 Drawing Figures

PLASTIC FILE SLEEVE AND INDEX CARDS

This is a continuation of application Ser. No. 738648 Filed Nov. 4, 1976 now abandoned.

BACKGROUND OF THE INVENTION

This invention relates to the field of index file cards and cases therefor.

In the prior art, the cards typically are inserted completely into the case, including the projecting tab portions, and a cover for the case is provided. In order to look at the index tabs, the cover must be lifted and one must reach down into the case in order to remove a card. Of necessity, such a case must be sufficiently oversize to provide room for one's thumb and fingers to reach in to partially examine and retrieve a desired card. Such excess space allows cards to lean, to eventually bend and become deformed.

The sleeve in accordance with the present invention is relatively narrow and compact for a given number of index cards, since there is no need to reach into the sleeve cavity to examine or retrieve a desired card. The entire tabulating strip portion is supported above the case and may be visually inspected in its entirety outside of the sleeve. The upwardly projecting tabs may be flexed to examine the portion of the card lying behind each tab. Each card may furthermore be withdrawn from the sleeve by grasping the tabulating strip portion which projects above the sleeve and without reaching into the cavity. The fact that the index cards in accordance with this invention can be packed so compactly in the sleeve makes it possible to use without a cover.

SUMMARY OF THE INVENTION

It is an object to provide a file case and index card set, comprising a sleeve having a sleeve cavity corresponding to the configuration and dimension of the body portion of said set of index cards to hold said set of cards snugly therein, the cards of said set having a top border portion wider than said body portion which remains outside of the sleeve cavity, said top border portion including shoulder portions extending outwardly from each opposite end to overhand the corresponding portion of the sleeve adjacent thereto when the body portion of said cards are inserted in the sleeve cavity.

It is an object of the invention to provide a file case and index card set wherein the file case is of the sleeve type open at the top and bottom to prevent accumulation of dirt and debris therein.

It is an object of the invention to provide a file case and index card set which is compact requiring minimal space for storing a given number of index cards.

It is an object of the invention to provide a file case and index card set wherein the cards are held compactly together in the case and have an outwardly projecting portion for viewing and for grasping to retrieve.

It is an object of the invention to provide a file case and index card set which includes means on the cards to prevent complete insertion thereof into the case.

DESCRIPTION OF PREFERRED EMBODIMENT

Figure 1:
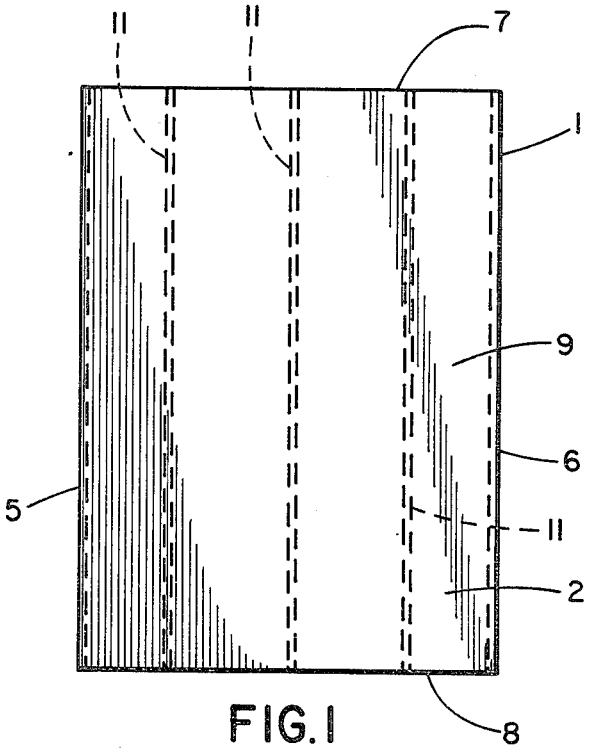
FIG. 1 is an elevation view of a sleeve file case in accordance with this invention.
Figure 3:
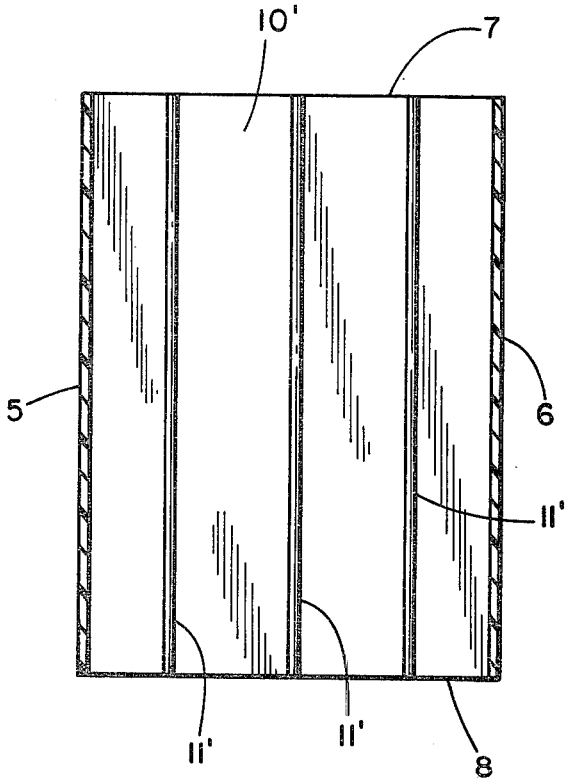
FIG. 3 is a section taken on line 3 — 3 of FIG. 2.
Figure 2:
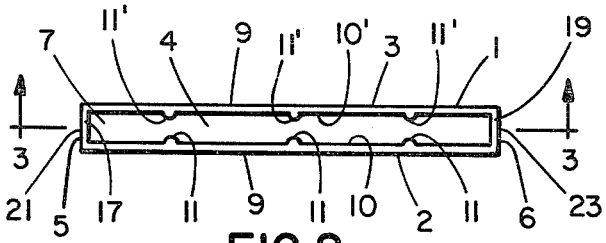
FIG. 2 is a top plan view of the sleeve file case shown in FIG. 1.
Figure 4:
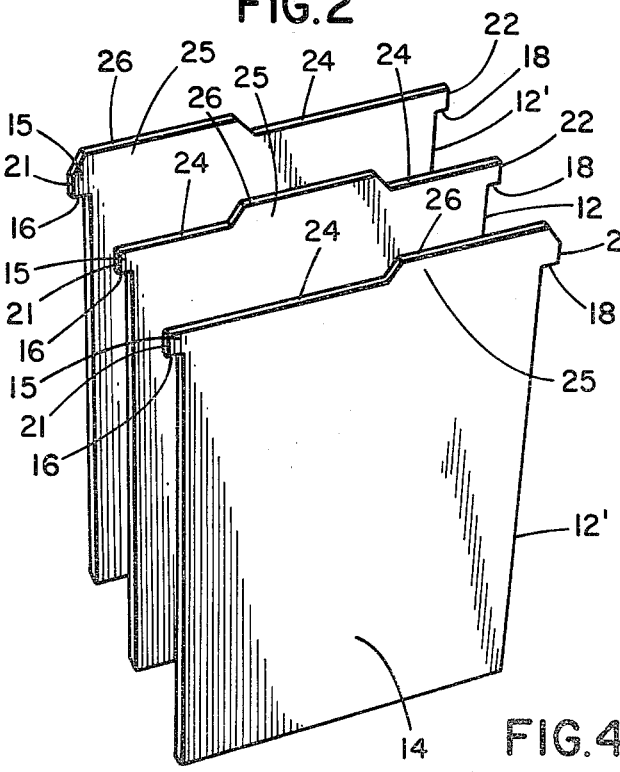
FIG. 4 is a perspective view of three index cards in accordance with this invention.
Figure 5:
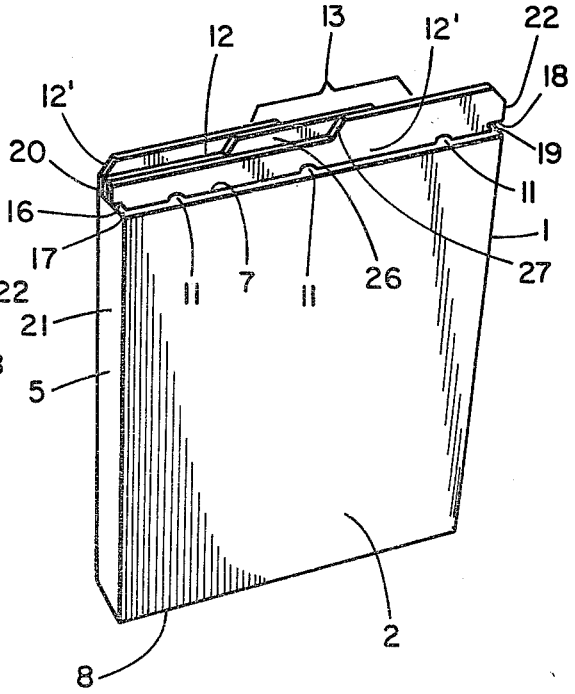
FIG. 5 is a perspective view of a sleeve file case with index cards inserted therein in accordance with this invention.

A sleeve file case 1 includes a relatively wide front end wall 2 and a correspondingly wide rear end wall 3 spaced apart to define a relatively narrow sleeve cavity 4 therebetween having relatively narrow side walls 5 and 6 bounding the sides of cavity 4. The case 1 is preferably of generally rectangular cross-section.

The top 7 and bottom 8 of sleeve cavity 4 are open, whereby sleeve cavity 4 provides a through passageway to allow dust, debris and other unwanted items to pass completely through and to prevent such matter from accumulating in the sleeve file case.

Front end wall 2 and rear end wall 3 include smooth outward facing surfaces 9 and 9' respectively. The end walls 2 and 3 include inward facing surfaces 10 and 10' respectively, each of which include longitudinally extending ribs 11 and 11' projecting inwardly respectively from surfaces 10 and 10' into sleeve cavity 4.

The longitudinal ribs 11 projecting from inward facing surface 10, and the longitudinal ribs 11' projecting from inward facing surface 10', are in spaced apart parallel relationship to each other on their respective walls. Each longitudinal rib 11 projecting from surface 10 is in direct facing relationship with a corresponding longitudinal rib 11' projecting from opposite surface 10'.

The longitudinal ribs 11 and 11' extend in the same directions as the direction of movement of index cards 12 into and out of the sleeve cavity 4. The ribs 11 and 11' therefore serve as abutting surfaces for the respective cards 12 which are adjacent thereto, thus spacing the cards slightly apart from the respective inward facing surfaces 10 and 10'. The ribs 11 and 11' in this manner serve as runners to minimize the area of frictional contact between the end cards 12' of a card set and the corresponding end walls of the sleeve file case 1. Thus the card set, or individual end cards, may be more easily withdrawn even though a relatively large number of cards are included in a set and packed compactly together.

The ribs 11 and 11' also serve to reinforce the respective end walls 2 and 3.

A plurality of cards 12 comprise a card set 13 of tabulated or index cards. Each card 12 includes a main body portion 14 for writing or typing thereon or otherwise recording information thereon, and a top border portion 15. The body portion 14 has a width corresponding to the width across sleeve cavity 4 between side walls 5 and 6 for entry of body portion 14 into sleeve cavity 4 and withdrawal therefrom. Such width of body portion 14 is therefore slightly less than the width across sleeve cavity 4 between side walls 5 and 6.

The length of the main body portion 14 of cards 12 corresponds to the length of sleeve file case 1 from the top 7 to the bottom 8. The cards may be shorter, and if desired they may be longer than said length of sleeve file case 1 since it is open both at the top 7 and at the bottom 8.

The top border portion 15 of cards 12 is integrally connected to the main body portion 14, and includes overhang shoulder 16 to seat against the top edge 17 of side wall 5 when the card 12 is inserted and overhang shoulder 18 to seat against the top edge 19 of side wall 6 when so inserted. The top border portion includes side edge 20 which is coplanar with the outer surface 21 of side wall 5 when card 12 is inserted, and opposite side edge 22 which is coplanar with the outer surface 23 of side wall 6 when so inserted.

The side edges 20 and 22 extend from the respective overhang shoulders 16 and 18 to the top edge 24 which extends along the top of card 12. An elongated tab 25 projects upwardly from the top edge 24 and extends across a portion of the width of the card 12, having a top tab edge 26 which extends on a line parallel to top edge 24 of the top border portion 15. The elongated tab 25 has a width less than the width of top border portion 15 between its side edges 20 and 22.

The tab 25 of each card 12 in the card set 13 is offset from that of each other card in the set. Thus, when a card set 13 is inserted in the sleeve file case 1, a visible index portion 26 of each tab 25 of each card 12 extends laterally beyond a corresponding side edge 27 of the tab 25 of the immediately preceding card 12.

The sleeve file case 1 in accordance with this invention may be of plastic, wood, metal, or cardboard. Since it is tubular in form comprising a sleeve open at both ends, will all peripheral surfaces of the end walls 2 and 3, the side walls 5 and 6, as well as of the longitudinal ribs 11 extending in planes which are parallel to the longitudinal axis of the sleeve cavity 4, the sleeve file case 1 may be conveniently extruded from materials such as aluminum to make a light weight metal case. This particular construction also facilitates production of the case by other manufacturing methods such as injection molding. The device may also be cast in long tubular sections and then cross cut into a number of individual sleeve file cases 1.

The index cards 2 may be of paper, plastic, metal or other thin flexible sheet material.

In use, a plurality of index cards 12 having offset elongated tabs 25 as described are stacked into a set 13, with their respective main body portions 14 and top border portions 15 in overlying relationship, and with the respective elongated tabs 25 offset so a visible index portion 26 of each card is uncovered and extends laterally beyond a corresponding side edge of the immediately preceding card.

The main body portions 14 of the cards in the stacked set 13 are then inserted into the sleeve cavity 4 until the shoulders 16 and 18 of the top border portions 15 contact and seat against the top edge 17 of side wall 5 and top edge 19 of side wall 6. The cards 12 are thus inserted to the intended limit in the sleeve file case 1, with their respective top border portions 15 extending outwardly from the top 8 of the case 1.

The number of cards in a set 13 is selected to conform to the dimension of sleeve cavity 4 between the longitudinal ribs 11 of front end wall 2 and the longitudinal ribs 11' of rear end wall 3. It is not necessary to allow any room at either end of sleeve cavity 4 for purposes of manipulating the cards, since the top border portions 15 and tabs 25 project above the sleeve file case and may be flexed for inspection and other purposes without disturbing or moving the main body portions 14 of other cards 12.

The longitudinal ribs 11 and 11' bear against the respective end cards 12' and resiliently apply pressure thereagainst serving to hold said set 13 of cards 12 in said sleeve cavity 4.

We Claim:

1. A sleeve file case and card set, comprising a tubular member, said tubular member including a central cavity therethrough which opens to both opposite ends of said tubular member, a plurality of cards slidably positioned in said cavity being slidably removable therefrom, each of said cards including a body portion having a transverse dimension corresponding to that of said central cavity for insertion of said body portion in said cavity, each of said cards being in substantially full frictional engagement with at least one other of said cards, wherein said tubular member is rectangular in cross-section having the same cross-sectional dimension and configuration for one end of said tubular member to the other, a first relatively wide end wall, a second relatively wide end wall spaced apart from said first end wall to define said central cavity between said end walls, a top edge of said end walls bordering the opening of said cavity at one end thereof, a bottom edge of said end walls bordering the opening of said cavity at the opposite end thereof, and a plurality of longitudinal ribs formed on the inner surfaces of said end walls projecting into said cavity to contact an adjacent one of said cards and space said cards from said inner surfaces of said end walls, said plurality of ribs on each end wall being spaced apart a first distance to reduce friction between said cards and said end walls when said cards are tightly packed in said cavity, said first distance being greater than the cross-sectional dimension of one of said ribs, each of said ribs extending from one end of said tubular member to the other and each of said ribs having the same cross-sectional configuration and dimension continuously from one end of said tubular member to the other wherein said plurality of cards includes a first card, said first card includes a main body portion having a width less than the width of said cavity of said tubular member, a top border portion having a width greater than the width of said cavity, said means to retain said cards in position in said cavity including an overhang portion of said top border portion which exceeds the width of said cavity, and extends laterally beyond said cavity and across at least a portion of the top edge of said side walls when said card is inserted therein.

2. A sleeve file case and card set as set forth in claim 1, wherein said plurality of longitudinal ribs includes a first plurality of said ribs on said first end wall, a second plurality of said ribs on said second end wall, the number of ribs in each of said pluralities being equal, the ribs on said first end wall being in facing relationship respectively to corresponding ones of said ribs on said second end wall.

3. A sleeve file case and card set as set forth in claim 2, including a pair of side walls respectively joining said first and second end walls along the opposite edges thereof, said side walls and said end walls having said longitudinal ribs comprising the entire peripheral boundary of said cavity, the surfaces of said end walls lying continuously in respective ones of spaced apart first planes extending through said cavity, the surfaces of said longitudinal ribs lying continously in respective ones of a plurality of second planes extending through said cavity, the surfaces of said side walls lying continuously in respective ones of spaced apart third planes extending through said cavity, said first, second and third planes extending through said cavity being continuously parallel to the longitudinal axis of said cavity from one end thereof to the other, said tubular member being of extrudable material, whereby said tubular member of said sleeve file case may be completely formed by drawing a block of said extrudable material through an extrusion die having a core wall of cross-sectional configuration and dimension corresponding to the cross-sectional configuration and dimension of said surfaces of said end walls, said longitudinal ribs and said side walls.

4. A sleeve file case and card set as set forth in claim 2, wherein said top border portion includes a top edge, and a tab projecting from said top edge.

5. A sleeve file case and card set as set forth in claim 4, wherein said tab is elongated laterally and located on said first card at a position adjacent a first side edge of said first card, said plurality of cards including a second card, said second card including a laterally elongated tab which is laterally offset from said tab of said first card.

6. A sleeve file case and card set as set forth in claim 1, wherein said plurality of cards are in stacked relationship having a stacked thickness equal to a first dimension, said central cavity of said tubular member being of rectangular cross-section having a relatively narrow cross-sectional dimension between corresponding bounding surfaces along the sides thereof and a relatively wide cross-sectional dimension between corresponding bounding surfaces along the side edges of said wide cross-sectional dimension, including said corresponding bounding surfaces along the sides of said relatively narrow cross-sectional dimension of said cavity, said relatively narrow cross-sectional dimension of said cavity being substantially equal to said first dimension of said stacked plurality of cards, said corresponding bounding surfaces bordering the sides of said relatively narrow cross-sectional dimension bearing firmly against respective end ones of said stacked plurality of cards, said corresponding bounding surfaces bordering the sides of said relatively narrow cross-sectional dimension being included in said means to retain said cards in said position in said cavity.

7. A sleeve file case and card set as set forth in claim 6, wherein said corresponding bounding surfaces along the sides of said relatively narrow cross-sectional dimension of said cavity includes a rib.

8. A sleeve file case and card set as set forth in claim 1, wherein said tubular member is rectangular in cross-section, a pair of relatively wide spaced apart end walls of said tubular member, a first relatively narrow side wall joining said end walls along one edge thereof, a second relatively narrow side wall joining said end walls along the opposite edge thereof, said first and second side walls including respective outwardly facing surfaces facing oppositely of each other, said outwardly facing surfaces lying in respective spaced apart parallel planes, said top border portion of said first card including a first side edge on one side thereof and a second side edge on the opposite side thereof, said first side edge of said top border being coplanar with said first side wall of said tubular member, said second side edge of said top border portion being coplanar with said second side wall of said tubular member.

* * * * *